US008636439B2

(12) United States Patent
Jaouen

(10) Patent No.: US 8,636,439 B2
(45) Date of Patent: Jan. 28, 2014

(54) LATCHING MECHANISM

(76) Inventor: Jean Jacques Jaouen, Gloucester, VA (US)

( * ) Notice: Subject to any disclaimer, the term of this patent is extended or adjusted under 35 U.S.C. 154(b) by 0 days.

(21) Appl. No.: 13/459,443

(22) Filed: Apr. 30, 2012

(65) Prior Publication Data

US 2012/0213576 A1 Aug. 23, 2012

Related U.S. Application Data

(63) Continuation-in-part of application No. 12/821,658, filed on Jun. 23, 2010, now Pat. No. 8,167,175.

(60) Provisional application No. 61/230,569, filed on Jul. 31, 2009, provisional application No. 61/262,243, filed on Nov. 18, 2009.

(51) Int. Cl.
*B67D 7/78* (2010.01)

(52) U.S. Cl.
USPC ..... 403/322.3

(58) Field of Classification Search
USPC ..... 403/322.2, 325, 328
See application file for complete search history.

(56) References Cited

U.S. PATENT DOCUMENTS

| | | | | | |
|---|---|---|---|---|---|
| 2,729,417 | A * | 1/1956 | Maynard | 410/111 |
| 3,101,641 | A * | 8/1963 | Walker et al. | 411/348 |
| 3,596,554 | A * | 8/1971 | Low et al. | 411/348 |
| 5,692,851 | A * | 12/1997 | Pace | 403/31 |
| 6,077,011 | A * | 6/2000 | Walker | 411/348 |
| 6,193,325 | B1 * | 2/2001 | Lin | 301/111.03 |
| 6,331,091 | B2 * | 12/2001 | Cross | 403/322.2 |
| 6,386,789 | B1 * | 5/2002 | Chausse et al. | 403/322.2 |
| 6,840,703 | B2 * | 1/2005 | Blanchard | 403/322.2 |
| 8,162,581 | B2 * | 4/2012 | Soltis et al. | 411/348 |
| 2008/0016636 | A1 * | 1/2008 | Morris et al. | 15/145 |

* cited by examiner

*Primary Examiner* — Joshua Kennedy
(74) *Attorney, Agent, or Firm* — Miller Law Group, PLLC

(57) ABSTRACT

A latching mechanism includes a pusher member formed with an internal ring and being attached to a first object. A center post formed with a relief groove is secured to a release button and is connected to a second object. A slidable sleeve biased upwardly surrounds the center post and carries a pair of detent balls in a position to be alignable with the relief groove. The internal ring of the pusher member pushes the detent balls downwardly until the detent balls become aligned with the relief groove allowing the internal ring pass below the detent balls and thus latch the first and second objects together. Release is attained by pressing the release button to raise the center post into alignment with the detent balls to allow the internal ring to move past the detent balls and affect a release of the latching mechanism.

11 Claims, 5 Drawing Sheets

Fig. 3
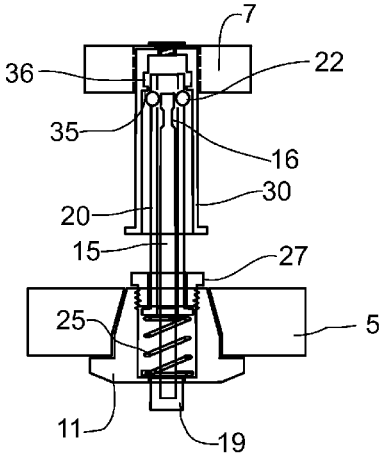
Fig. 4
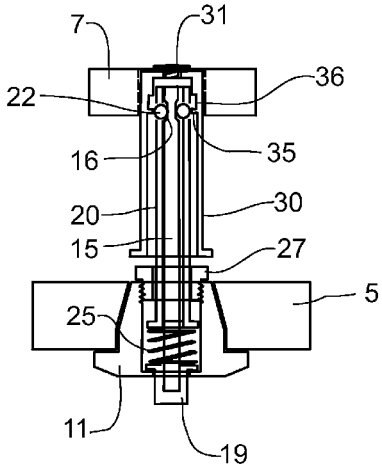
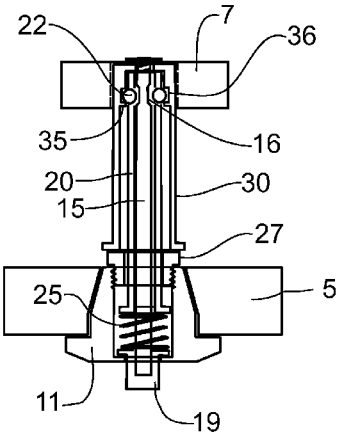
Fig. 5

Fig. 6
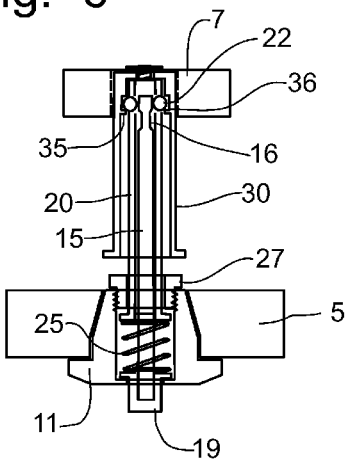
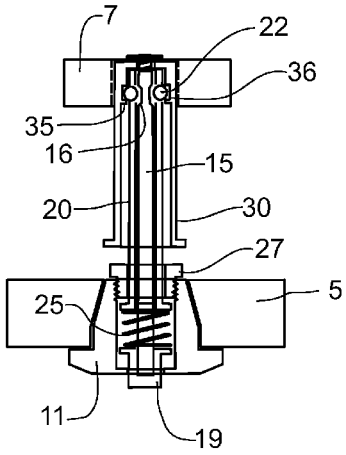
Fig. 7
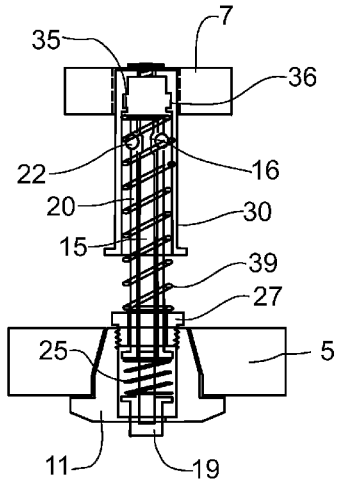
Fig. 8

LATCHING MECHANISM

CROSS-REFERENCE TO RELATED APPLICATIONS

This application is a continuation-in-part of U.S. patent application Ser. No. 12/821,658, issued as U.S. Pat. No. 8,167,175 on May 1, 2012, the contents of which are incorporated herein by reference, and this application claims domestic priority on U.S. Provisional Patent Application Ser. No. 61/230,569, filed Jun. 25, 2009, and on U.S. Provisional Patent Application Ser. No. 61/262,243, filed on Nov. 18, 2009, the contents of which are incorporated herein by reference.

FIELD OF THE INVENTION

The present invention generally relates to a latching mechanism for connecting one object to another and, more particularly, to a detent mechanism that provides a connection of two objects with a push button release.

BACKGROUND OF THE INVENTION

Latching mechanisms can be used to connect two objects together under circumstances where the two objects can be selectively separated. Convenient operation of the latching mechanism will enhance the use thereof, particularly where the latching mechanism can be released easily and with minimal effort. For example, it would be desirable for a latching mechanism to be operable to connect two objects simply by pushing the two objects together, while separation of the two objects would be effected simply by pressing a button and pulling the two objects apart.

Such a latching mechanism can have utilization for connecting a key ring to a key fob with the latching mechanism interconnecting the key ring and the key fob. Such a latching mechanism could also be used to latch a door against a frame, such as a cabinet door as an example. Other examples include applications in aviation, boating, recreational vehicles, and automotive vehicles. This need for a latching mechanism that easily connect two objects together without even requiring the pressing of a button can be used in substantially any mechanical application. This latching mechanism can also be used to connect a bottom member of a bottle with an expandable plunger to be operated within the bottle to dispense product therefrom.

Accordingly, it would be desirable to provide a latching mechanism that can be adapted for use in a number of applications where the release of two objects from one another can be affected by the pressing of a release button.

SUMMARY OF THE INVENTION

It is an object of this invention to provide a latching mechanism that can be used to connect two objects together and to disconnect the two objects for separation from one another by the pressing of a release button.

It is another object of this invention to provide a latching mechanism that is operable to connect two objects together simply by pushing the two objects together.

It is a feature of this invention that the latching mechanism is formed with a pair of detent balls positioned internally of the latching mechanism to control the movement of internal components.

It is an advantage of this invention that the detent balls will move into a relief groove when the two internal components are to be moved relative to one another.

It is another feature of this invention that the latching mechanism is formed with a center post into which a relief groove is formed to define a head member above the groove.

It is still another feature of this invention that the latching mechanism also includes a sleeve surrounding the center post to carry the detent balls for movement with the sleeve relative to the center post.

It is another advantage of this invention that the sleeve is biased upwardly by a compression spring.

It is yet another feature of this invention that the latching mechanism also includes a pusher member that is affixed to one object while the center post is associated with the second object to which the first object is to be connected.

It is another feature of this invention that the pusher member is formed with an internal ring that engages the detent balls carried by the slidable sleeve when the pusher member is moved toward the second object.

It is yet another advantage of this invention that the internal ring on the pusher member pushes the detent balls into the relief groove in the center post when the detent balls become aligned with the relief groove.

It is another advantage of this invention that the internal ring can pass by the detent balls when moved into the relief groove and engaged beneath the detent balls to prevent the pusher member from moving axially relative to the center post to secure the first and second objects together.

It is a further advantage of this invention that the release of the latching mechanism can be released by the pressing of a release button.

It is a further feature of this invention that the depressing of the release pushes the center post upwardly to align the relief groove with the detent balls.

It is still another feature of this invention that the pusher member is capable of moving past the detent balls to allow the latching mechanism to separate.

It is yet another object of this invention to provide an automatic latching mechanism that will connect two objects together by simply pushing the corresponding latch components together, with a selective disconnection requiring only the pressing of a release button.

It is yet another advantage of this invention that the latching mechanism is automatically operable to connect two objects together by moving the objects toward one another with the latching components aligned.

It is yet another object of this invention that the latching mechanism can be used in a mixing bottle to secure a detachable bottom of the bottle to a telescopic plunger that is movable within the bottle.

It is yet another object of this invention to provide a latching mechanism to connect two objects together for selective release which is durable in construction, inexpensive of manufacture, carefree of maintenance, facile in assemblage, and simple and effective in use.

These and other objects, features and advantages are accomplished according to the instant invention by providing a latching mechanism having a pusher member formed with an internal ring and being attached to a first object. A center post formed with a relief groove is secured to a release button and is connected to a second object. A slidable sleeve biased upwardly surrounds the center post and carries a pair of detent balls in a position to be alignable with the relief groove. The internal ring of the pusher member pushes the detent balls downwardly until the detent balls become aligned with the relief groove allowing the internal ring pass below the detent balls and thus latch the first and second objects together. Release is attained by pressing the release button to raise the center post into alignment with the detent balls to allow the internal ring to move past the detent balls and affect a release of the latching mechanism.

BRIEF DESCRIPTION OF THE DRAWINGS

The advantages of this invention will be apparent upon consideration of the following detailed disclosure of the invention, especially when taken in conjunction with the accompanying drawings wherein:

FIGS. 3-8 are cross-sectional views of the latching mechanism showing the progress of the locking sequence;

DETAILED DESCRIPTION OF THE PREFERRED EMBODIMENT

Figure 1:
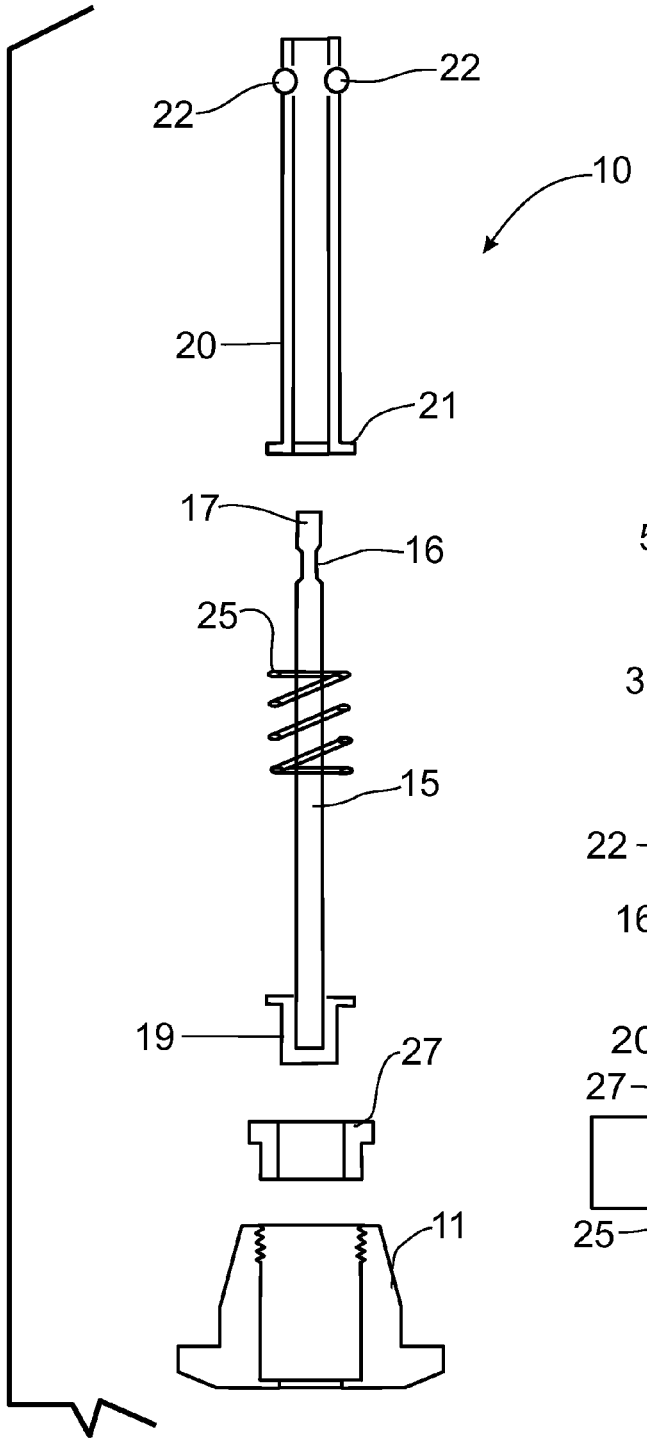
FIG. 1 is an exploded view of the latching mechanism incorporating the principles of the instant invention for selectively connecting two objects together.
Figure 2:
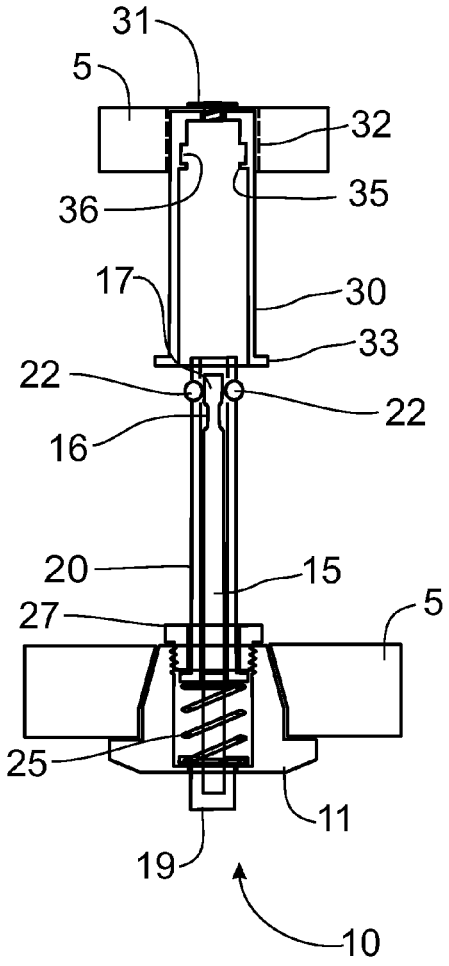
FIG. 2 is an assembled view of the latching mechanism in the operative locking position connecting two objects together.

Referring to FIGS. 1 and 2, a latching mechanism incorporating the principles of the instant invention can best be seen. The latching mechanism 10 includes a base member 11 that secured in a suitable manner to a first object 5. The base member 11 is formed with a vertical center post 15 formed with a relief 16 near the upper end thereof. A vertically slidable sleeve 20 surrounds the center post 15 and carries a pair of opposing transversely movable detent balls 22 near the upper end thereof. The sleeve 20 is biased upwardly by a compression spring 25 so that the detent balls 22 are normally transversely aligned with the head 17 of the center post 15, pushing the detent balls 22 transversely outwardly. Alternatively, the base member 11 can be integrally formed into the first object 5 and made a part thereof.

The slidable sleeve 20 is retained within the base member 11 by a retainer 27 that is secured to the base member 11 in a suitable manner, such as by being threaded into the base member, as depicted in the drawings. The slidable sleeve 20 includes a retention rim 21 that is captured by the retainer 27. The compression spring 25 is located below the slidable sleeve 20 to bias the sleeve 20 upwardly away from the base member 11. The center post 15 is coupled to a release button 19 that projects from the base member 11 within a cutout formed therein. The release button 19 is captured below the compression spring 25 so that the force of the spring 25 biases the release button 19 into engagement with the base member 11. The slidable sleeve 20 is trapped within the retainer 27 by the retention rim 21. The compression spring 25 compressed between the retention rim 21 of the slidable sleeve and the flange on the release button 19 biases the slidable sleeve 20 into an uppermost position that corresponds to the detent balls 22 being aligned with the head 17 of the center post 15 so that the detent balls 22 are pushed outwardly from the sleeve 20.

A pusher member 30 is secured to a second object 7 in a suitable manner, such as by a fastener 31. Alternatively, the pusher member 30 can be formed as an integral part of the second object 7, or the second object can be formed with a socket 32 that receives the pusher member 30 for connection thereto by the fastener 31. Preferably, the pusher member 30 has a cylindrical configuration that terminates in a flange 33 extending around the distal end of the pusher member 30. The pusher member 30 is also formed with an internal ring 35 near the proximal end of the pusher member 30. The internal ring 35 defines a bypass groove 36 between the internal ring 35 and the proximal end of the pusher member 30. The overall length of the pusher member 30 is a matter of accommodating the design of the objects being connected together, so long as the pusher member 30 is operable to push down on the detent balls 22 and allow a release as is described in greater detail below. The pusher member 30 can also be cooperative with an ejection spring 39, best seen in FIG. 8, that is trapped between the internal ring 35 and the retainer 27 to bias the pusher member 30 away from the retainer 27 when the pusher member 30 has been pushed into the locked position, as is also described in greater detail below.

In operation, the initial position of the latching mechanism 10 is representatively shown in FIG. 3 with the detent balls 22 being aligned with the head 17 of the center post 15. To reach this position, the second object 7 carrying the pusher member 30 is moved toward the first object 5 in a manner that aligns the pusher member 30 over the slidable sleeve 20 until the internal ring 35 is about to contact the detent balls 22 which are pushed outward due to the positioning thereof in alignment with the head 17 of the center post 15. Therefore, when the pusher member 30 is pressed downwardly toward the first object 5, the internal ring 35 cannot move past the detent balls 47 as the detent balls 47 are prevented from moving inwardly due to the interference with the head 17. As a result, the continued downward movement of the pusher member 30 pushes against the detent balls 22 to compress the sleeve 20 downwardly against the compression spring 25 until the detent balls 22 align with the relief groove 16 in the center post 15 below the head 17, as is depicted in FIG. 4. Once the detent balls 22 have become aligned with the relief groove 16, the internal ring 35 will push the detent balls into the relief groove 16 to allow the detent balls 22 to pass below the detent balls 22, as is depicted in FIG. 5.

Once the internal ring 35 passes below the detent balls 22, the downward force exerted on the sleeve 20 to compress the compression spring 25 disappears and the sleeve 20 is free to return to it prior uppermost vertical position, where the detent balls 22 are aligned with the head 17 of the center post 15, by the expansion of the compression spring 49, as is depicted in FIG. 6. As the sleeve 20 moves upwardly, the detent balls 22 are engaged by the underside of the head 17 and are forced outwardly into the bypass groove 36 formed in the top of the pusher member 30 above the internal ring 35, thereby trapping the internal ring 33*a* below the detent balls 48. At this point the latching mechanism 10 connects the first and second objects together as the latching mechanism 10 attains the lock position as is shown in FIG. 2.

When the two objects 5, 7 are to be separated from one another, the latching mechanism 10 is released from the locked position shown in FIG. 6. To accomplish the release of the latching mechanism 10, the release button 19 is depressed toward the second object 7, as is depicted in FIG. 7, which causes the center post 15 to move upwardly relative to the slidable sleeve 20 while compressing the compression spring 25 against the retention rim 21 of the sleeve 20. The upward movement of the center post 15 causes the relief groove 16 to become aligned with the detent balls 22. An upward force applied to the pusher member 30, which can come from the two objects 5, 7 being pulled apart or, preferably, by a biasing force exerted by an optional ejection spring 39 compressed between the internal ring 35 and the top of the retainer 27, pushes the detent balls 22 into the relief groove 16 allowing the internal ring 35 of the pusher member 30 to move past the detent balls 22. The second object 7 can then be separated from the first object 5, as is depicted in FIG. 8.

This latching mechanism 10 can be utilized in a number of different applications where two objects are desired to be joined together and selectively separated. One such application is the connection of a key ring to a key fob. This latching mechanism can also be used to latch a pivoted member to a base member, such as a pivoted drawer front to a drawer frame. The latching mechanism 10 makes a very secure connection of the two objects and the release of that connection requires only the depression of the release button 19. As is described in U.S. Pat. No. 8,167,175, this latching mechanism 10 can be used in a mixing bottle 40 to secure a bottom member 42 of the mixing bottle 40 to the telescopic plunger 45, which is shown in FIGS. 9 and 10.

Figure 9:
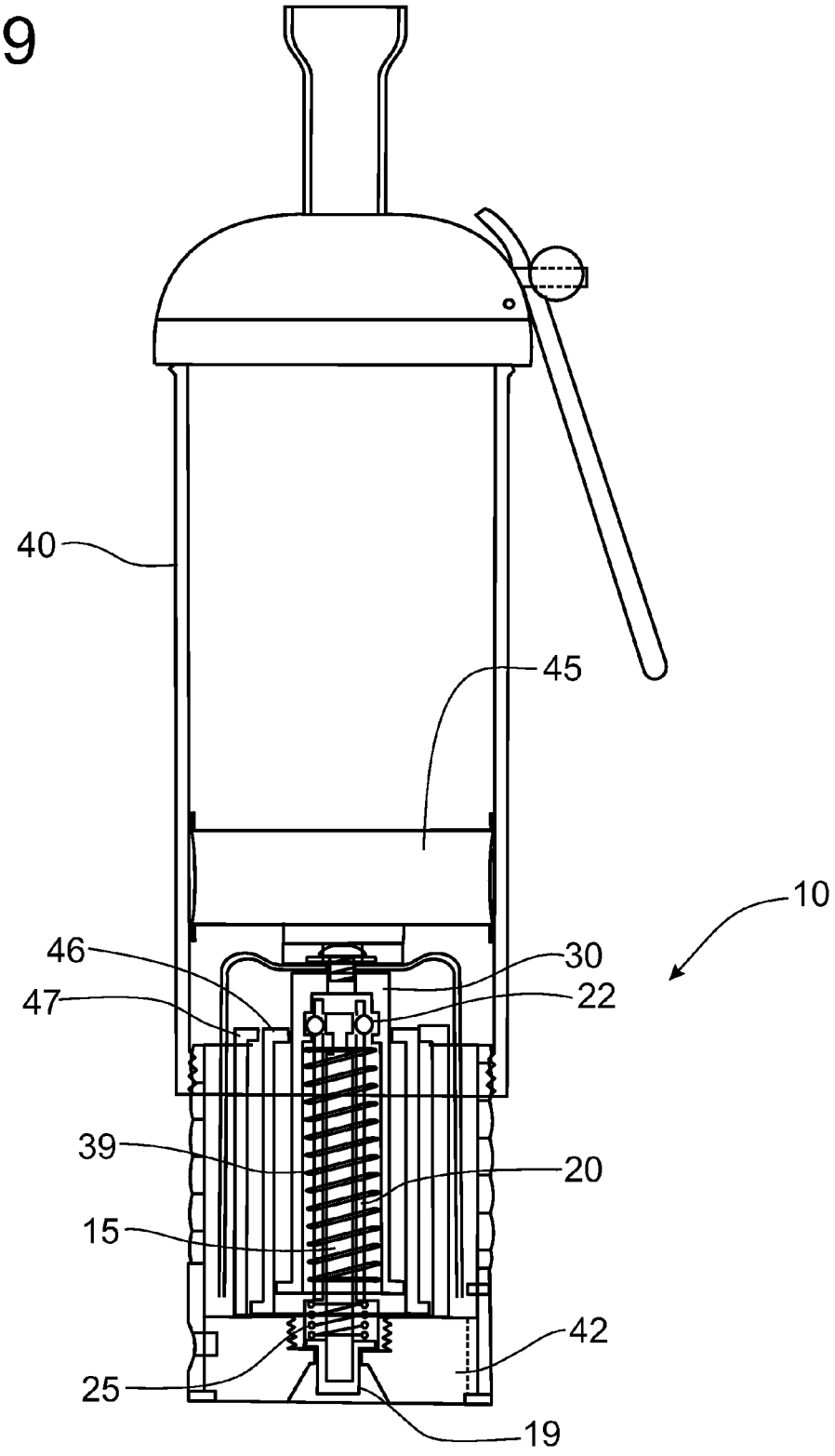
FIG. 9 is a partial cross-sectional view of a mixing bottle providing an exemplary application of the utilization of the latching mechanism which is depicted in the operative locking position.
Figure 10:
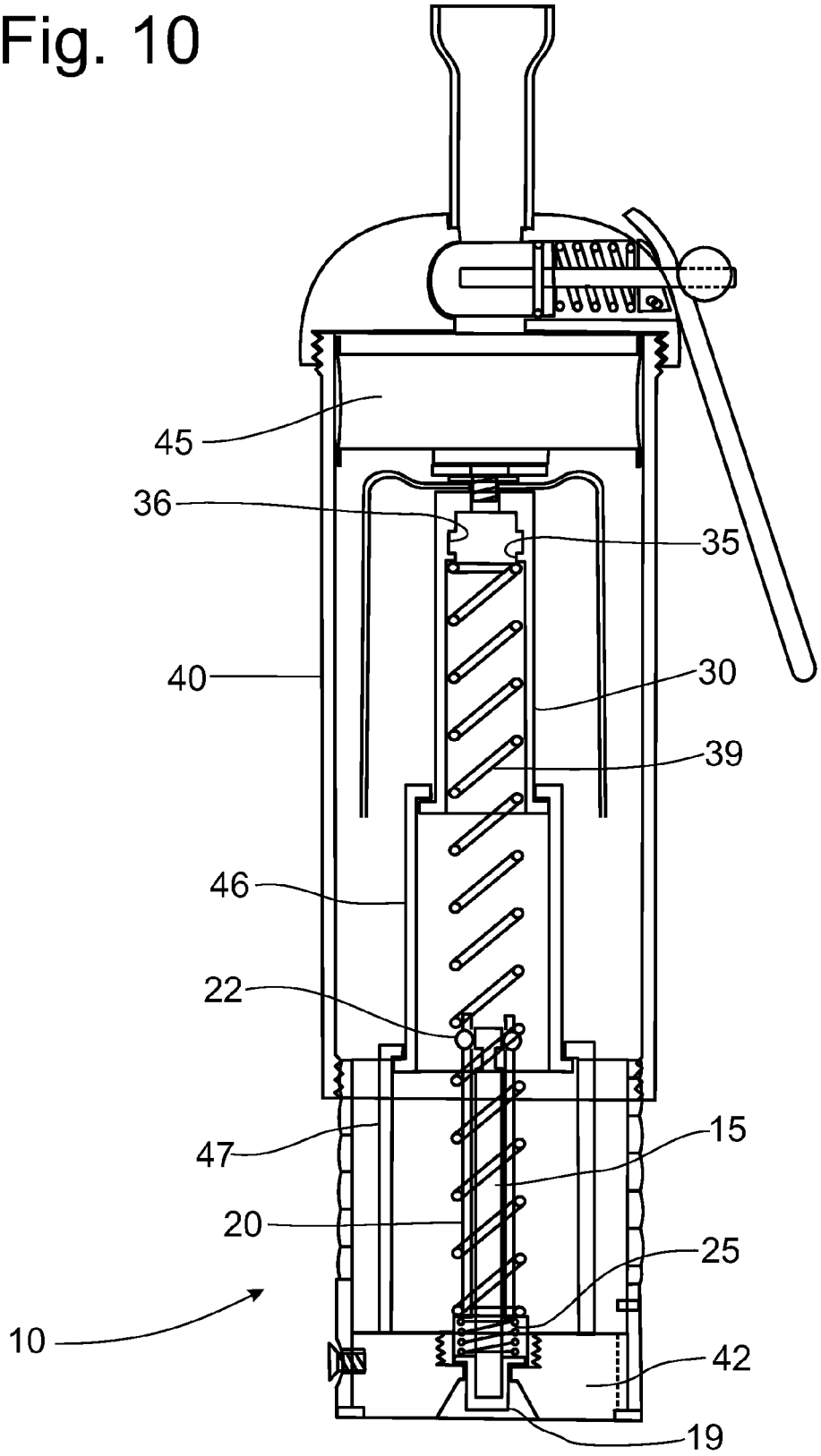
FIG. 10 is a partial cross-sectional view of the mixing bottle shown in the release position to allow the plunger to move away from the bottom member of the bottle.

The mixing bottle 40 is representatively shown in FIG. 9 in a compressed configuration with the latching mechanism 10 in the locked position as is shown in FIG. 2, holding the plunger 45 in a collapsed position while the mixing bottle 40 is filled with components to be mixed together. In FIG. 10, the latching mechanism 10 is released to allow the plunger 35 to move upwardly dispensing the mixed product from the bottle 40. In the configuration of the mixing bottle 40, as shown in FIGS. 9 and 10, the pusher member 30 is coupled to nesting telescopic members 46, 47 and utilizes a long ejection spring 39 to force the pusher member 30 far away from the base member 11. Furthermore, the base member 11 is built into the bottom member 42 and made an integral part thereof.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

For example, the above described latching mechanism can be formed in a manner that only utilizes one detent ball 22 instead of a pair of detent balls 22, although the symmetrical version with cylindrical members and annular grooves cooperable with a pair of detent balls 22 is preferable.

Having thus described the invention, what is claimed is:

1. A latching mechanism for detachably connecting two objects, comprising:

a base member mounted with a first object;

an upright center post projecting upwardly from said base member and being formed with a head and a relief groove below said head;

a slidable sleeve surrounding said center post and being vertically movable relative to said center post and relative to said base member, said sleeve being biased into an uppermost position by a compression spring and being movable into a lowermost position by compressing said compression spring;

at least one detent ball carried by said sleeve and being laterally movable between an outward lock position when aligned with said head of said center post and an inward release position when aligned with said relief groove; and a pusher member being secured to a second object and being formed with an internal ring that is engagable with said at least one detent ball when in said outward lock position, said pusher member being sized to pass over and move relative to said slidable sleeve, whereby said pusher member is secured to said slidable sleeve by pushing said at least one detent ball into said relief groove until said at least one detent ball is aligned with said internal ring and said center post is moved relative to said slidable sleeve to engage said head with said at least one detent ball to force said at least one detent ball into said internal ring; and whereby said pusher member can be released from said slidable sleeve by moving said center post to align said relief groove with said at least one detent ball to enable said pusher member to force said at least one detent ball out of said internal ring and into said relief groove to permit said pusher member to move relative to said slidable sleeve.

2. The latching mechanism of claim 1 further comprising a release button coupled to said center post to move said center post relative to said sleeve when said release button is depressed.

3. The latching mechanism of claim 2 wherein the depressing of said release button moves said center post upwardly to align said relief groove with said at least one detent ball so that said at least one detent ball can be moved into said relief groove to allow said internal ring to move past said at least one detent ball.

4. The latching mechanism of claim 3 wherein said pusher member is cylindrical and said slidable sleeve carries a pair of detent balls movable between said outward lock position and said inward release position.

5. The latching mechanism of claim 4 wherein the positioning of said internal ring of said pusher member below said detent balls while said detent balls are aligned with the head of said center post orients said latching mechanism into a locked position.

6. The latching mechanism of claim 5 further comprising an ejection spring carried by said pusher member to be compressed when said pusher member is in said locked position.

7. The latching mechanism of claim 5 wherein said base member includes a retainer cooperable with said slidable sleeve to limit upward movement of said sleeve to said upper most position, said retainer further capturing said compression spring between said sleeve and said release button.

8. The latching mechanism of claim 7 wherein the depression of said release button compresses said compression spring against said sleeve.

9. A latching mechanism for detachably connecting two objects, comprising:

a base member mounted with a first object, said base member including a retainer;

an upright center post projecting upwardly from said base member and being formed with a head and a relief groove below said head;

a release button coupled to said center post;

a slidable sleeve surrounding said center post and being vertically movable relative to said center post and relative to said base member, said sleeve being biased into an uppermost position by a compression spring captured by said retainer between said sleeve and said release button, said sleeve being movable into a lowermost position by compressing said compression spring;

a pair of detent balls carried by said sleeve and being laterally movable between an outward lock position when aligned with said head of said center post and an inward release position when aligned with said relief groove;

a pusher member being secured to a second object and being formed with an internal ring that is engagable with said detent balls when in said outward lock position to orient said pusher member in a locked position, said pusher member being sized to surround said slidable sleeve; and an ejection spring carried by said pusher member to be compressed when said pusher member is in said locked position to bias the pusher member toward movement, whereby said pusher member is secured to said slidable sleeve by pushing said at least one detent ball into said relief groove until said at least one detent ball is aligned with said internal ring and said center post is moved relative to said slidable sleeve to engage said head with said at least one detent ball to force said at least one detent ball into said internal ring; and whereby said pusher member can be released from said slidable sleeve by moving said center post to align said relief groove with said at least one detent ball to enable said pusher member to force said at least one detent ball out of said internal ring and into said relief groove to permit said pusher member to move relative to said slidable sleeve through the bias force applied by said ejection spring.

10. The latching mechanism of claim 9 wherein the depressing of said release button moves said center post upwardly to align said relief groove with said detent balls so that said detent balls can be moved into said relief groove to allow said internal ring to move past said detent balls.

11. The latching mechanism of claim 10 wherein said pusher member is cylindrical, the positioning of said internal ring of said pusher member below said detent balls while said detent balls are aligned with the head of said center post orients said latching mechanism into a locked position.

* * * * *